US009723395B2

(12) United States Patent
Kim

(10) Patent No.: US 9,723,395 B2
(45) Date of Patent: Aug. 1, 2017

(54) PORTABLE SOUND EQUIPMENT

(71) Applicant: LG ELECTRONICS INC., Seoul (KR)

(72) Inventor: Sungwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 15 days.

(21) Appl. No.: 14/836,556

(22) Filed: Aug. 26, 2015

(65) Prior Publication Data

US 2016/0366506 A1 Dec. 15, 2016

(30) Foreign Application Priority Data

Jun. 15, 2015 (KR) ..... 10-2015-0084583

(51) Int. Cl.

*H04R 25/00* (2006.01)
*H04R 1/10* (2006.01)
*H04R 5/033* (2006.01)

(52) U.S. Cl.

CPC ..... *H04R 1/105* (2013.01); *H04R 1/1033* (2013.01); *H04R 1/1091* (2013.01); *H04R 5/0335* (2013.01); *H04R 1/1016* (2013.01); *H04R 1/1041* (2013.01); *H04R 1/1066* (2013.01); *H04R 1/1075* (2013.01); *H04R 2201/105* (2013.01); *H04R 2201/107* (2013.01); *H04R 2420/07* (2013.01); *H04R 2460/03* (2013.01)

(58) Field of Classification Search

CPC ..... H04R 1/105; H04R 1/1091; H04R 1/1033
USPC ..... 381/370, 371, 374, 376–381
See application file for complete search history.

(56) References Cited

U.S. PATENT DOCUMENTS

| | | | | |
|---|---|---|---|---|
| 5,715,323 | A | 2/1998 | Walker | |
| 2013/0256345 | A1* | 10/2013 | Larkin | A45C 11/00 224/201 |
| 2013/0329903 | A1* | 12/2013 | Ting | H04R 1/105 381/74 |
| 2016/0066078 | A1* | 3/2016 | Baek | G06F 1/163 381/74 |

FOREIGN PATENT DOCUMENTS

| | | | |
|---|---|---|---|
| JP | 2001-169382 | A | 6/2001 |
| KR | 10-0422605 | B1 | 7/2004 |
| KR | 20-0408656 | Y1 | 2/2006 |
| KR | 10-0725657 | B1 | 6/2007 |
| KR | 10-0872845 | B1 | 12/2008 |
| KR | 10-2012-0017920 | A | 2/2012 |

(Continued)

*Primary Examiner* — Brian Ensey
(74) *Attorney, Agent, or Firm* — Birch, Stewart, Kolasch & Birch, LLP

(57) ABSTRACT

A portable sound equipment including a flexible band with variable curvature, a pair of housings coupled to both ends of the band, respectively, an earbud holder provided in each of the housings, an earbud detachably held in the earbud holder and outputting sounds, a controller provided in the housing and connected to the earbud to control the sound output unit, a sound signal wire configured to connect the earbud and the controller with each other and a wingtip detachably coupled to an end of the housing and having an elastic material, where the wingtip includes a rubber ring to expose the earbud holders and the earbuds and the sound cables penetrate an opening of the rubber ring.

20 Claims, 12 Drawing Sheets

(56) References Cited

FOREIGN PATENT DOCUMENTS

| | | | |
|---|---|---|---|
| KR | 10-1365926 | B1 | 2/2014 |
| KR | 10-1471903 | B1 | 12/2014 |
| KR | 10-1507869 | B1 | 4/2015 |

* cited by examiner

PORTABLE SOUND EQUIPMENT

Pursuant to 35 U.S.C. §119(a), this application claims the benefit of earlier filing date and right of priority to Korean Application No. 10-2015-0084583, filed on Jun. 15, 2015, the contents of which are hereby incorporated by reference herein in their entirety.

BACKGROUND OF THE DISCLOSURE

Field of the Disclosure

Embodiments of the present disclosure relates to a mobile terminal and a portable sound equipment which may receive an audio signal from a terminal via wireless communication and transmit a control signal for controlling the terminal.

Discussion of the Related Art

The sound equipment means the audio device which can receive an audio signal from a terminal and transmit the audio information collected via a microphone to the terminal. Conventionally, a wire type sound equipment is used which connects a terminal of a wireless sound equipment to an ear jack of a terminal to receive an audio signal. In recent, there are increasing demands for the wireless communication type wireless sound equipment in an aspect of mobility and user convenience.

Wireless sound equipment having a design considering mobility is under development such as headphone type wireless sound equipment, ear wearable type wireless sound equipment and ear inserting type wireless sound equipment. The headphone type is band-shaped to be worn on a user's head such that a user can carry it easily.

Recently, there are increasing demands for wireless sound equipment having a band to be wearable on a user's neck to allow a user to carry easily even in case a receiver is not worn on a user's ear.

SUMMARY OF THE DISCLOSURE

An object of the present disclosure is to provide the portable sound equipment which is wearable during exercises or sport activities, with convenient portability and which expand functions.

To achieve these objects and other advantages and in accordance with the purpose of the disclosure, as embodied and broadly described herein, a portable sound equipment includes a flexible band with variable curvature; a pair of housings coupled to both ends of the band, respectively; an earbud holder provided in each of the housings; an earbud detachably held in the earbud holder and comprising a sound output unit detachably coupled to the earbud holder; a controller provided in the housing and connected to the earbud to control the sound output unit; a sound signal wire configured to connect the earbud and the controller with each other; and a wingtip detachably coupled to an end of the housing and comprising an elastic material.

The portable sound equipment may further include a wingtip coupling groove recessed along a circumference of the housing; and a wingtip fixing projection projected from the wingtip coupling groove along a longitudinal direction of the housing, wherein the wingtip includes a rubber ring coupled to the wingtip coupling groove; and a rubber cap projected from the rubber ring to cover the wingtip fixing projection.

A width of the wingtip coupling groove may be variable along a circumferential direction of the housing.

The portable sound equipment may further include a first terminal formed in the wingtip coupling groove and connected to the controller; and a second terminal formed in the rubber ring, corresponding to the first terminal, and connected to an electronic components mounted in the wingtip.

The flexible band and the housing may form a C-shaped curvature and comprise a contact surface in contact with the user's neck when a user wears the portable sound equipment around the neck.

The wingtip may further include a compensating rib extended from the rubber ring and configured to cover the contact surface of the housing.

The rubber cap may be extended longer than the wingtip fixing projection and lengthens the C-shaped curvature.

The earbud holder may be provided in an end of the housing, and the earbud may penetrate the rubber ring. The wingtip fixing projection may have a contact surface continued from the contact surface of the C-shaped curvature.

The portable sound equipment may further include a switch provided in the housing or the flexible band, wherein the flexible band and the housing form a C-shaped curvature and comprise a contact surface in contact with the user's neck when a user wears the portable sound equipment around the neck, and the switch generates an ON signal when a user wears the portable sound equipment on the neck.

The switch may include a button projected on the contact surface of the C-shaped curvature, and the button may lead in and generate an ON signal when the user wears the portable sound equipment.

The switch may include one or more of a heart pulse sensor, a temperature sensor and an optical sensor provided on the contact surface the C-shaped curvature.

The switch may include a sensor provided in the flexible band and configured to sense curvature variation of the flexible band. When the curvature of the flexible band is kept as a second curvature smaller than a first curvature after varied into a first curvature, the switch may generate the ON signal.

The portable sound equipment may further include a wireless communication unit configured to transmit and receive a signal to and from an external terminal, wherein the controller switches on the power when sensing the ON signal and synchronizes the portable sound equipment with the external terminal.

The flexible band may include a shape memory alloy wire provided therein; a signal wire configured to transmit and receive a signal traveling between the pair of the housings; a coupling bracket provided in each end of the flexible band to couple with the housings; and a band cover configured to cover the shape memory alloy wire and the signal wire partially and integrally formed with the shape memory alloy wire, the signal wire and the coupling bracket in a manner of insert injection molding.

The portable sound equipment may further include a polymer pipe configured to cover the signal wire and the shape memory alloy wire.

The flexible band and the housing include a polyurethane material or polyurethane may be coated on the flexible band and the housing.

The flexible band or the housing may include a length adjusting unit having a variable length and configured to keep the varied length.

The portable sound equipment further include a speaker mounted in the housing and configured to output a signal according to an audio signal; and a sound hole formed adjacent to the flexible band of the housing and configured to output the sound generated in the speaker.

The portable sound equipment may further include an auto-winding device mounted in the housing and configured to have a sound cable wound there around, wherein the auto-winding device includes a shaft fixed to the housing; a wheel rotary on the shaft and having the sound cable wound there around; a plate spring comprising one end coupled to the shaft and the other end coupled to an internal portion of the wheel; and a board connected to the controller and linked to one end of the wheel, wherein when a user pulls the sound cable, the sound cable is released from the wheel and the wheel is rotated in a first direction, and when the user removes the force, the wheel is rotated in a second direction by the restitution force of the plate spring and the cable is wound around the wheel.

The auto-winding device may further include a plurality of moving rails formed in a surface of the wheel in plural-arcs shape; a stopping groove provided between the moving rails; a linear slot formed in a predetermined position which faces the rails; and a ball fitted between the slot and the moving rails and configured to move along the slot according to the rotation of the wheel and to restrict the rotation of the wheel when held in the stopping groove.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
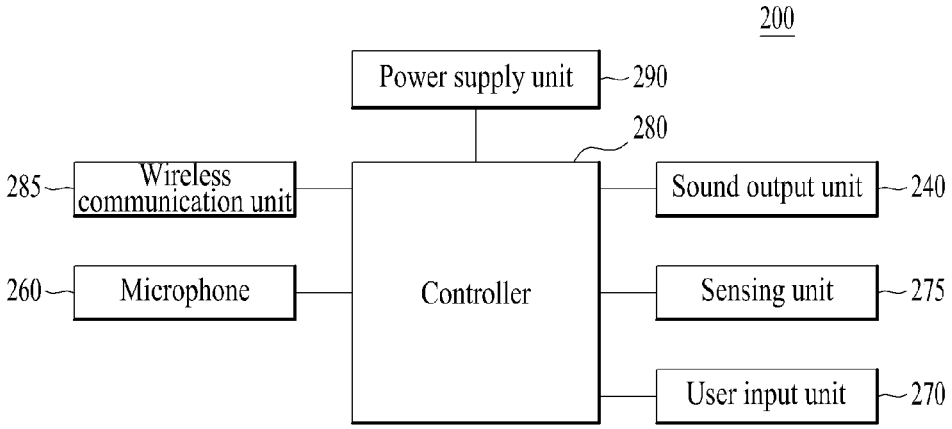
FIG. 1 is a block diagram of a portable sound equipment in accordance with the present disclosure.

FIG. 1 is a block diagram illustrating the portable sound equipment according to one embodiment of the disclosure. The portable sound equipment 200 includes a controller 250, a wireless communication unit 255, a sound output unit 240, a sensing unit 275, a microphone 260, a user input unit and a power supply unit 257.

The sound output unit 240 is a mechanism configured to output sounds according to an audio signal. An earbud is insertedly put on a user's ears to transmit sounds to the user. A speaker 243 is spaced apart a predetermined distance from the user's ears, not insertedly put on the user's ears, and configured to transmit sounds to the user. Accordingly, the sound output from the earbud 241 is more silent than the sound output from the speaker.

The microphone 260 processes an external audio signal into electrical voice data. The processed voice data is transmitted to the external terminal or external server via the wireless communication unit 285. Various noise removal algorithms can be realized in the microphone 260 to remove the noise generated while the external audio signal is input.

The sensing unit 275 is a device configured to recognize a state of the wireless sound equipment 200 and circumstances. The sensing unit 275 may include an illuminance sensor for sensing illuminance nearby, a touch sensor for sensing touch input, a gyro sensor for sensing a slope of and a location of the wireless sound equipment 200, and an earbud switch for sensing whether the earbud 241 is located in an earbud holder 225.

Figure 2:
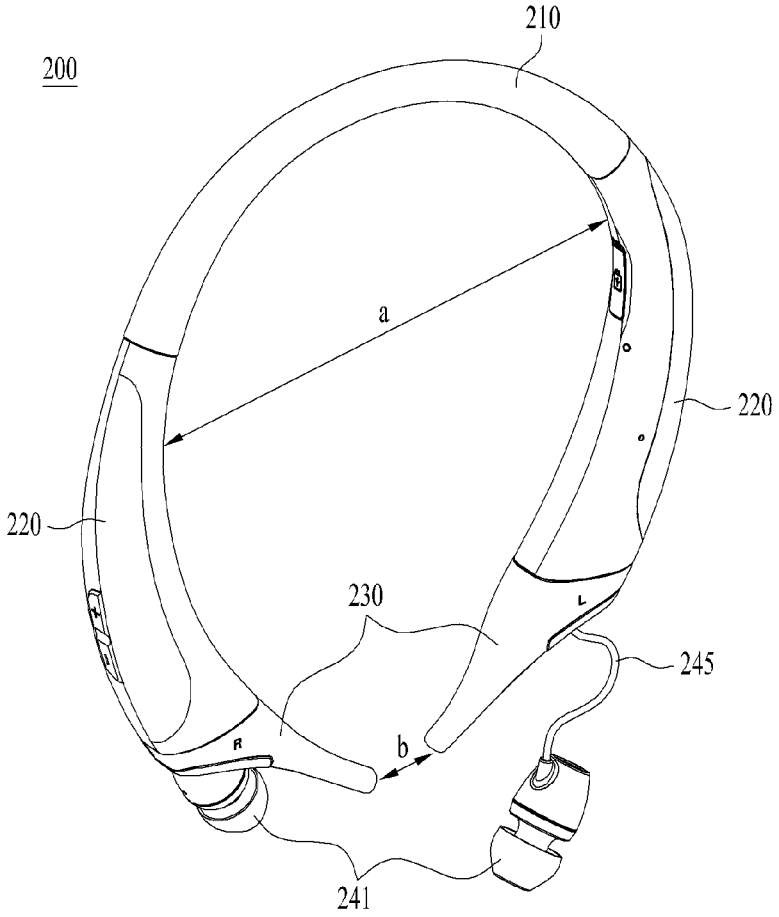
FIG. 2 is a conceptual view of one example of the portable sound equipment, viewed from one directions.
Figure 3:
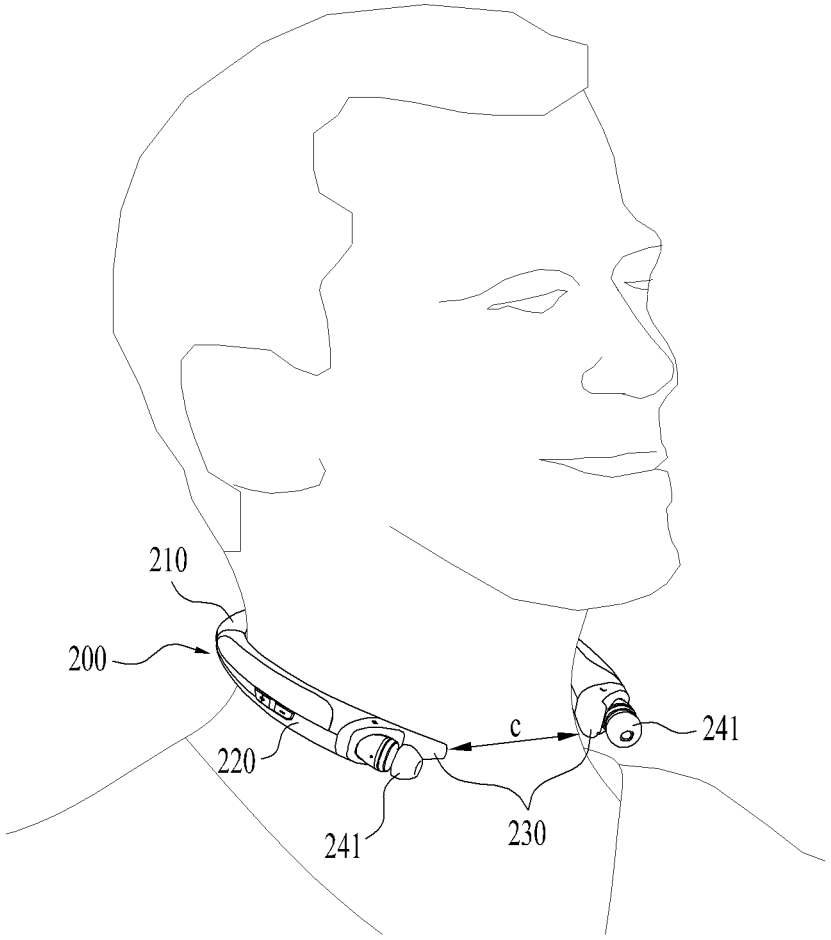
FIG. 3 is a diagram illustrating a state where one example of the portable sound equipment in accordance with the present disclosure is worn.

The user input unit 270 is configured to allow the user to control the portable sound equipment 200. The user input unit 270 may include a call button 272, a button 273 for an audio volume and a power button 271. FIG. 2 is a perspective diagram FIG. 2 is a conceptual view of one example of the portable sound equipment, viewed from one direction. FIG. 3 is a diagram illustrating a state where one example of the portable sound equipment in accordance with the present disclosure is worn. The flexible band 210 and the housing 220 which define the profile of the portable sound equipment 200 in accordance with the present disclosure may form a "C"-shaped curvature shown in FIG. 2.

The flexible band 210 is a curved-bar-shaped material having elasticity. When an external force is applied to the flexible band 210, the flexible band 210 is deformed in a predetermined range. When the force is removed, the flexible band 210 is restituted. The housing 220 is connected to both ends of the flexible band 210 and it is positioned in both ends of the C-shaped curvature. There may be insertedly loaded in the flexible band 210 diverse components including a printed circuit board 281, the speaker 243, the wireless communication unit 285, a battery 291 and the winding material 250.

The C-shaped portable sound equipment 200 shown in FIG. 3 may be worn on the user's neck, to be carried easily. Conventional wireless sound equipment is hung on the neck, not stably secured. When the user is walking or running, the conventional wireless sound equipment has a disadvantage of separated and falling from the neck. However, the portable wireless sound equipment in accordance with the present disclosure shown in FIG. 3 is worn by the user in a state of fitting the user's neck neatly. The portable wireless sound equipment may solve the disadvantage of the sound equipment hitting the collarbone when the user is jogging or doing exercises.

To be wearable on the user's neck stably, the portable sound equipment 200 may have an inner flat surface which is in contact with the user's neck. As the area in contact with the user's neck is getting wider, the portable sound equipment can be stably and securely worn on user's neck by the frictional force.

A gap between the ends of the C-shaped band is variable according to the deformation of the flexible band. A gap (b) between the ends of the portable sound equipment 200 is smaller than a diameter of the user's neck and the maximum diameter (a) of the portable sound equipment 200 is also smaller than the diameter of the user's neck, so that the portable sound equipment 200 worn on the user's neck can be fixedly worn.

Figure 4:
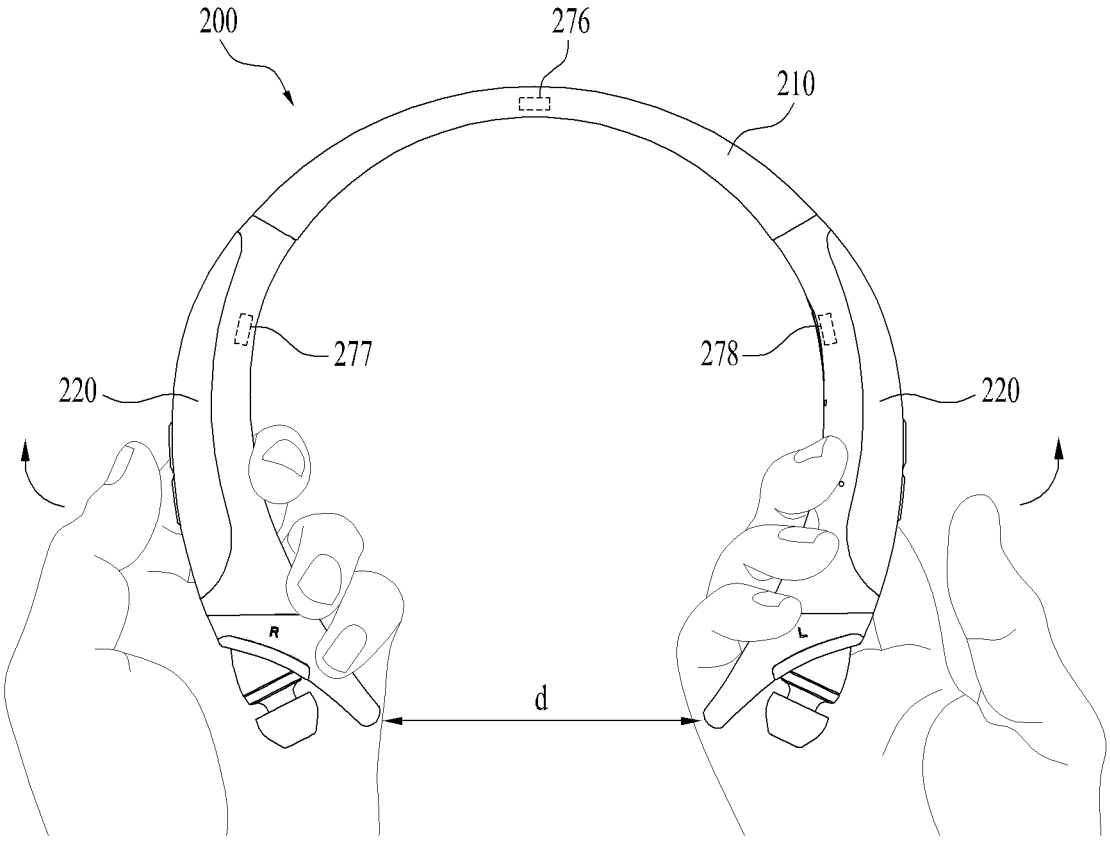
FIG. 4 is a diagram illustrating that a flexible band is deformed when one example of the portable sound equipment is worn.

FIG. 4 is a diagram illustrating a state where the ends of the portable sound equipment 200 are widened after the user deforms the flexible band 210 to wear the portable sound equipment 200. When an external force is applied to the flexible band 210 outwards (i.e., in the reverse of the curved direction of the flexible band 210), both ends of the portable sound equipment 200 shown in FIG. 4 are widened more largely (d) than the diameter of the user's neck. The maximum diameter (a) of the portable sound equipment 200 is smaller than the diameter of the user's neck. Accordingly, the force is applied in the reverse of the curved direction of the flexible band 210 when the user puts on the portable sound equipment 200 as shown in FIG. 3.

At this time, the flexible band 210 applies a force in a direction for tightening the neck, using the elastic force which tries to restitute an original position. The portable sound equipment 200 may be fixedly worn on the user's neck, not falling off from the neck. When the portable sound equipment 200 is worn on the user's neck, the gap (c) of both ends of the portable sound equipment 200 is wider than the gap of the ends in the state of FIG. 2 and narrower than the gap between the ends in the state of FIG. 4 where the ends are widened for the user to wear the portable sound equipment 200 ($b<c<d$).

A displacement sensor 276 is provided to sense variation of the curvature in the flexible band 21. Using the displacement sensor 276, it can be sensed whether the ends of the portable sound equipment 200 are widened when the user puts on the portable sound equipment 200 as shown in FIG. 4. In this instance, the curvature of the flexible band 210 is varied gently, to determine whether the user tries to use the portable sound equipment 200 and to switch it on or to synchronize it with an external terminal.

The displacement sensor 256 may also put into consideration the curvature after the curvature of the elastic band 210 is significantly changed, so as to precisely determine whether the user widens the ends to put on the portable sound equipment 200 or to the ends are widened while the user is carrying the portable sound equipment 200. After the curvature of the flexible band 210 is significantly changed into a first curvature, the curvature is fixed as a second curvature which is gentler than the first curvature sensed in a state the portable sound equipment 200 is rested. In this instance, it may be determined that the user wears the portable sound equipment 200.

Rather than the displacement sensor 276, a sensor 277 such as a temperature sensor, an optical sensor or a heat pulse sensor may be provided in a contact surface in contact with the user's neck when the portable sound equipment 200 is worn. In case a heat pulse is sensed or the temperature of the flexible band is in a range of human body temperatures or the brightness is darker, it is determined that the user puts on the portable sound equipment 200 and then the power of the portable equipment 200 is on or the wireless communication 285 is activated to synchronize the portable sound equipment 200 with an external terminal.

Alternatively, a switch 278 configured to be pressed physically may be provided. When the user puts on the portable sound equipment 200, the projected switch is pressed to generate an ON signal. When the ON state of the switch 278 is maintained for a predetermined time period or more, the power of the portable sound equipment 200 may be on or the portable sound equipment 200 may be synchronized with an external device.

A plurality of sensors 277 and switches 278 may be provided and the plurality of the values gained from the sensors and switches are combined to determine precisely whether the portable sound equipment is worn.

Figure 5:
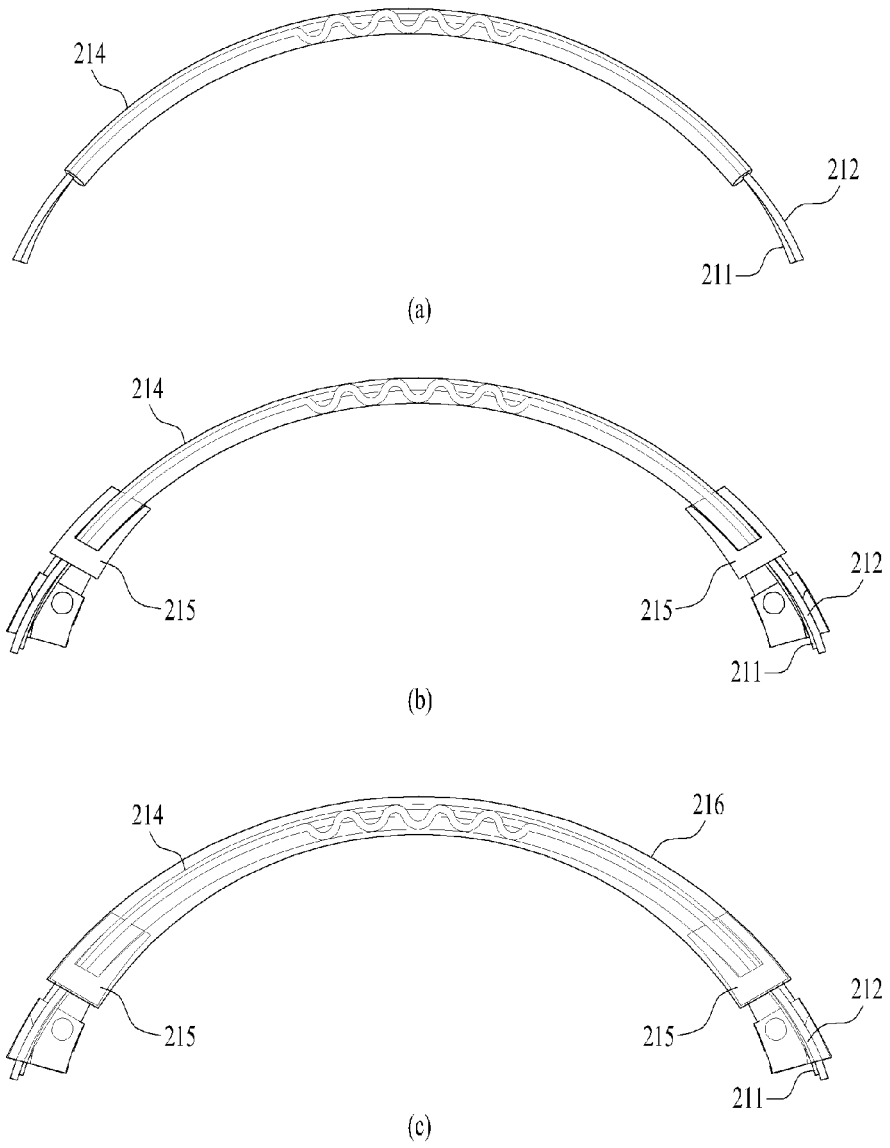
FIG. 5 is a diagram illustrating a fabrication process of the flexible band provided in one example of the portable sound equipment in accordance with the present disclosure.

FIG. 5 is a diagram illustrating a fabrication process of the flexible band 210 provided in one example of the portable sound equipment 200 in accordance with the present disclosure. As shown in (a), a shape memory alloy wire 211 and a signal wire are inserted in a pipe-shaped polymer tube 214 having elasticity. The shape memory alloy wire 211 provides the elasticity for restituting the curved state of the flexible band 210 with a predetermined curvature determined to keep the shape of FIG. 2, which is a basic state, when a force is applied to the flexible band 210. The signal wire 212 is configured to transmit and receive signals traveling between the components mounted in a left housing 220 and the components mounted in a right housing 220. The polymer tube 214 holds the signal wire 212 and the shape memory alloy wire 211 from separating apart from each other and it may be used in fixing a coupling bracket 215 which will be described later.

As shown in (b), a coupling bracket 215 is fitted to both ends of the polymer tube 214. The coupling bracket 215 is used in coupling the housing 220 to the flexible band 210. A hard plastic material with no elasticity may be used so as to be stably coupled to the housing 220. The coupling bracket 215 may include coupling hole and a coupling projection to be coupled to the housing 220. The shape memory alloy wire 211 and the signal wire 212 are exposed, penetrating the coupling bracket 215.

The material shown in (b) is inserted in a metallic mold and the injection molding product for partially covering the polymer tube 214 and the coupling bracket 215 is insert-injection molded as shown in (c), only to fabricate a band cover 216. When the band cover 216 is fabricated in the manner of the insert-injection molding, the shape memory alloy wire 211, the signal wire 212 and the coupling bracket 215 may be integrally formed with as one body. Even when the profile of the flexible band 210 is repeatedly deformed, the ends of the flexible band 210 may not be widened nor disassembled, so that the durability of the flexible band can be improved and that a water-proof function can be added. Accordingly, the sweat may not soak through the flexible band in contact with the user's body.

The band cover 216 uses thermoplastic poly urethane. The thermoplastic poly urethane is melt, using heat. When it is hardened, the thermoplastic poly urethane becomes an elastic material such as rubber, with soil resistance and wear resistance. As an overlapped area of the coupling bracket 215 and the band cover 216 is getting larger, the rigidity of the flexible band 210 is getting stronger and the flexible band 210 is not deformed easily.

Figure 6:
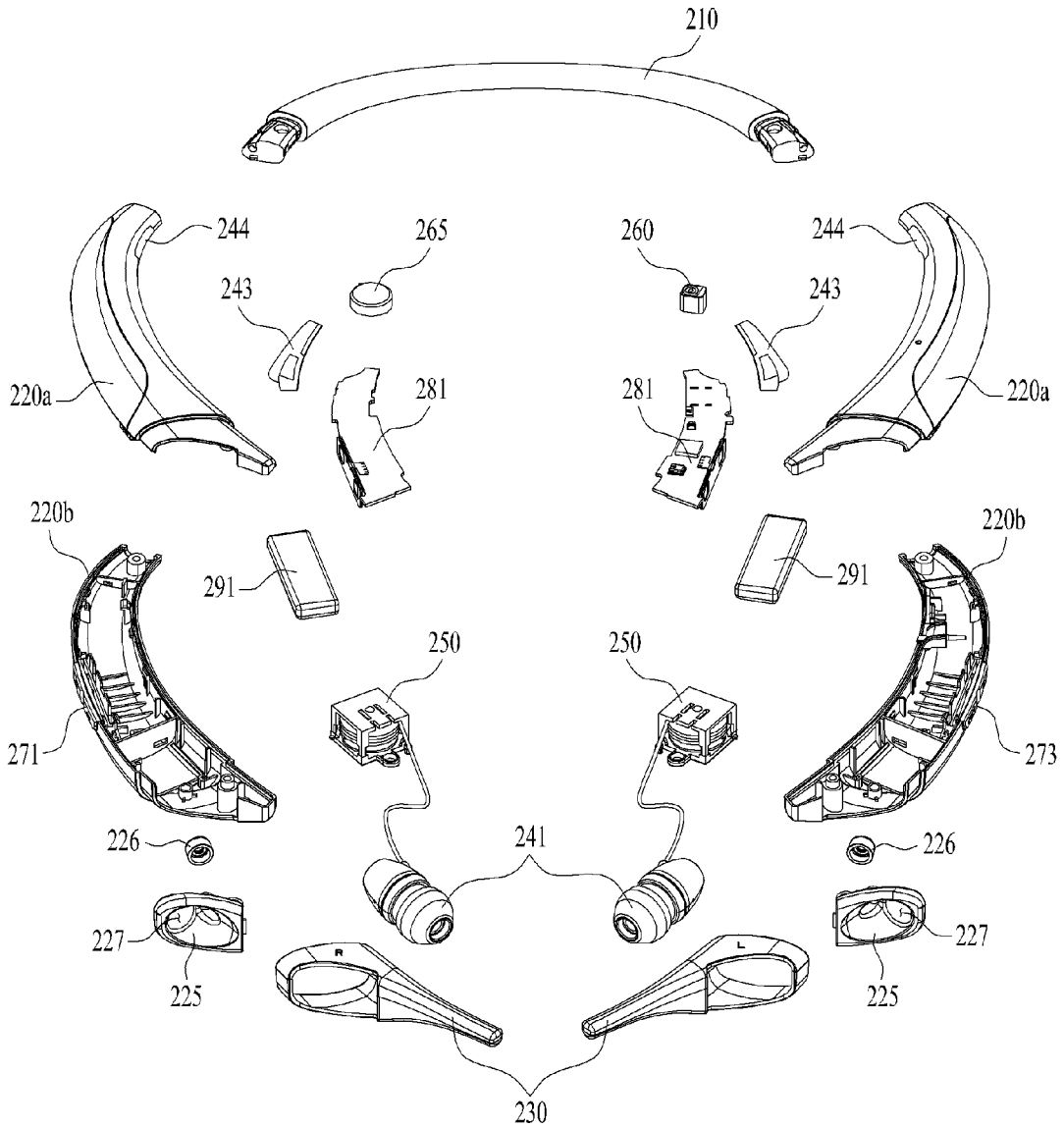
FIG. 6 is an exploded perspective diagram illustrating one example of the portable sound equipment in accordance with the present disclosure.
Figure 7:
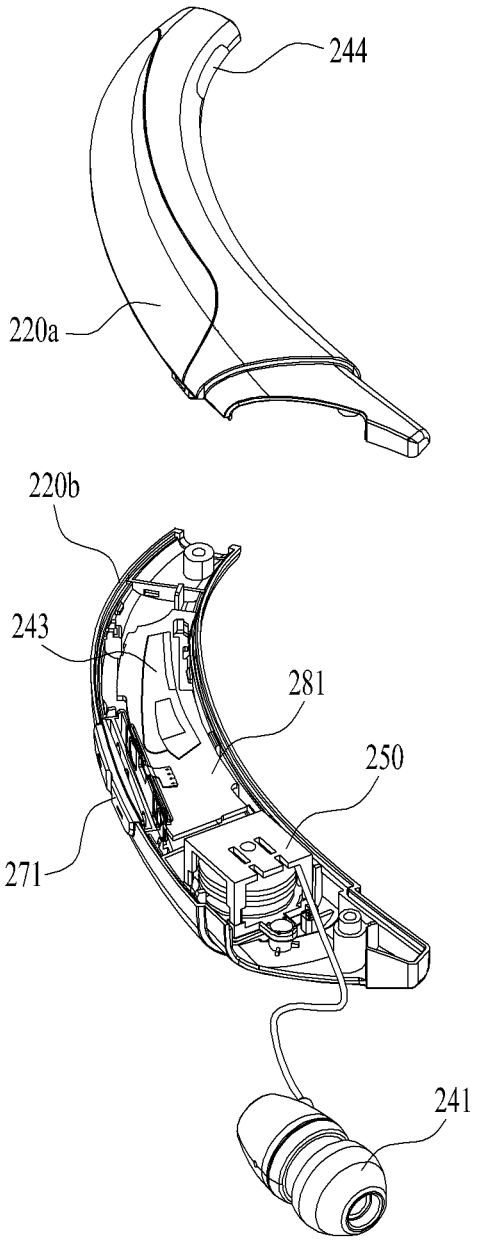
FIG. 7 is an exploded perspective diagram illustrating a housing provided in one example of the portable sound equipment in accordance with the present disclosure.

FIG. 6 is an exploded perspective diagram illustrating one example of the portable sound equipment 200 in accordance with the present disclosure. FIG. 7 is an exploded perspective diagram illustrating a housing provided in one example of the portable sound equipment 200 in accordance with the present disclosure.

The housing 220 coupled to both ends of the flexible band 210 includes an upper housing 210*a* and a lower housing 210*b*. The printed circuit board 281, the wireless communication unit 285, the battery 291, the microphone 260, the speaker 243, a vibration motor 265 and a winding device 250 are mounted between the upper housing 210*a* and the lower housing 210*b*.

The housing 220 is fabricated of polymer material in the manner of the injection molding. For example, a plastic material having a predetermined strength such as polystyrene may be used. Also, the housing 220 may partially include a dissimilar material such as metal, glass or leather. The material of the housing 220 may be equal to the material of the coupling bracket 215 and different from the material of the band cover 216.

Thermoplastic poly urethane (TPU) used in fabricating the band cover 216 is elastic and easily deformed. When a force applied to TPU is removed, the TPU returns to an original profile and a surface of the TPU has a high friction coefficient enough to be in close contact with the user's body.

The housing 220 is formed of rigid polystyrene (PS) and polyurethane is coated on a surface of the housing 220 to protect internal components and to allow the housing 220 in close contact with the user's body simultaneously. When the polyurethane coating is performed on the surface of the housing 220, the portable sound equipment may have the profile with uniformity and both of the flexible band 210 and the housing may be in close contact with the user's skin. Accordingly, the portable sound equipment 200 may not be shaking according to the user's movement and it may have good wear sensation.

The portable sound equipment 200 which is wearable on the user's body is more likely to be exposed to moisture such as sweat. When it is provided with a waterproof function, the portable sound equipment 200 may have an improved durability. A rib may be formed or a waterproof material may be disposed, to cover a gap between the upper housing 220*a* and the lower housing 220*b* so as to prevent water from penetrating through the housing 210. When the polyurethane coating is performed with no auxiliary waterproof material disposed between the upper and lower housings, the upper housing 220*a* and the lower housing 220*b* may be sealed airtight.

The wireless communication unit 285 and the microphone 260 are loaded in the printed circuit board 281 mounted in the housing 220, and the printed circuit board 281 are connected to the battery 291, the user input unit 270 and the sound output unit 240. The components mounted in the housing 220 may be provided in both housings 220 symmetrically or the components may be provided in one housing to be used via the signal wire 212 embedded in the flexible band 210. For example, when the wireless communication unit 285 is provided in one housing 220, sounds may be output through the earbuds 240 provided in both sides, using the audio signal received by the wireless communication unit 285.

The wireless communication unit 285 may be mounted in the printed circuit board 281 or formed in a surface of the housing 220, so that it can transmit and receive a signal to and from an external terminal. Using short range wireless communication (e.g., Bluetooth), the wireless communication unit 285 may be synchronized with the external terminal and it may receive a control signal and an audio signal from the external terminal or transmit a control command and an audio signal, which are input via the user input unit and the microphone 260, to the external terminal.

The housing 220 may include a power button 271 for cutting off the power, a button 272 for playing music or receiving a call and a direction key 273 for adjusting a volume (the direction key may be configured to play the former or latter track). The buttons may be dome keys pressed physically or touch keys sensing input according to capacitance variation.

In case the button is a touch key, the position of the button is not limited to specific points and the surface of the housing 200 is used diversely. When the touch key is realized in the surface of the housing 220, the position and functions of the touch key may be displayed on the portion of the surface where the touch key is realized, using LEDs.

The earbud 240 is insertedly worn on the user's ear to transfer sounds and it is connected to the printed circuit board 281 via a sound cable 245. The printed circuit board 281 controls the earbuds 240 to output sounds according to the audio signal.

The housing 220 in accordance with the present disclosure includes earbud holders 225 provided in both sides to hold the earbuds 240, respectively. The earbud holder 225 includes a recess portion having a shape corresponding to the shape of the earbud 240 and the sound cable 245 connecting the earbud 240 to the printed circuit board 281 via a cable hole 227 passes through the earbud holder 225. The connection portion between the earbud 240 and the sound cable 245 is inserted in the cable hole 227, to guide the earbud 240 to locate in the earbud holder 225 precisely.

The earbud 240 has a predetermined size corresponding to the size of the user's earhole to be inserted in the user's ear. To provide various sized earbuds 240 diversified according to the size of the user's earhole, the earbud 240 includes a detachable ear cap formed of silicon or polyurethane. The ear cap may be exchangeable with a proper sized one suitable to the user's ear hole, when a new user uses the earbud. Also, when it gets dirty after use for a long time, the ear cap is replaced with a new one and there is a hygienic benefit.

Magnetic materials 226 (e.g., a magnet and a metallic material) may be provided in the earbud 240 and the earbud holder 225, respectively. When approaching the earbud holder 225, the earbud 240 can be automatically inserted in the earbud holder 225, using the magnetic force. An earbud sensor 240 may be further provided to sense whether the earbud 240 is held in the earbud holder 225. The user may control the portable sound equipment 200 according to presence of the earbud 240 in the earbud holder 225, using the earbud sensor.

For example, when only one of the earbuds 240 is separated from the earbud holder 225, the calling function of the mobile terminal may be activated or the wireless communication unit 285 may be activated to synchronize the portable sound equipment 200 with an external device. In addition, when both of the earbuds 240 are separated from the earbud holders 225, sound-related functions of the external device may be activated. When the earbuds 240 are held in the earbud holders 225, the playing music may be turned off or the synchronization with the external device may be ended.

It is difficult to provide the user with visual information, because the portable sound equipment 200 is worn on the user's neck. Accordingly, the user may be provided with an alarm, using the sound output unit 240 and the vibration motor 265. When the power is switched on or the portable sound equipment is synchronized with an external terminal or notice requiring situations including call signal receiving and message receiving are generated, vibration or alarm sounds may be provided to the user.

The battery 291 may be loaded in both sides of the housing 220 or only one side of the housing 220. The battery 291 may include a charger terminal for charging.

FIG. 7 is a diagram illustrating the shape of the electronic components mounted in the housing 220. An internal space of the housing 220 is divided into a plurality of areas and the speaker 243 is mounted in the area connected between the housing and the flexible band 210. The speaker 243 supplies sounds via the sound cable 245, spaced apart a predetermined distance from the user's ears, different from the earbud inserted in the user's ear, so that it can supply louder sounds than the earbud 240.

Compared with conventional speakers 243, the speaker 243 provided in the portable sound equipment 200 worn on the user's neck is used for allowing the user to listen to the music may be arranged in the nearest portion to the user's ear. As shown in FIG. 3, the nearest position to the user's ear is adjacent to the flexible band 210 of the housing 220. Accordingly, the speaker 243 may be provided adjacent to the flexible band 210 of the housing 220. A sound hole 244 may be arranged upwards or inwards (in a direction toward the user) to allow the sound output from the speaker 243 to reach the user's ear, not to spread around.

When the earbud 240 is held in the earbud holder 225, the sound cable 245 is wound around the auto-winding device 250 arranged in the housing 220 to be retracted into the housing 220, not exposed outside the portable sound equipment 200. The auto-winding device 250 may be arranged near the earbud holder 225 and it may be configured to wind the sound cable 245 around a wheel 255, using a restitution force of a plate spring 256.

Figure 8:
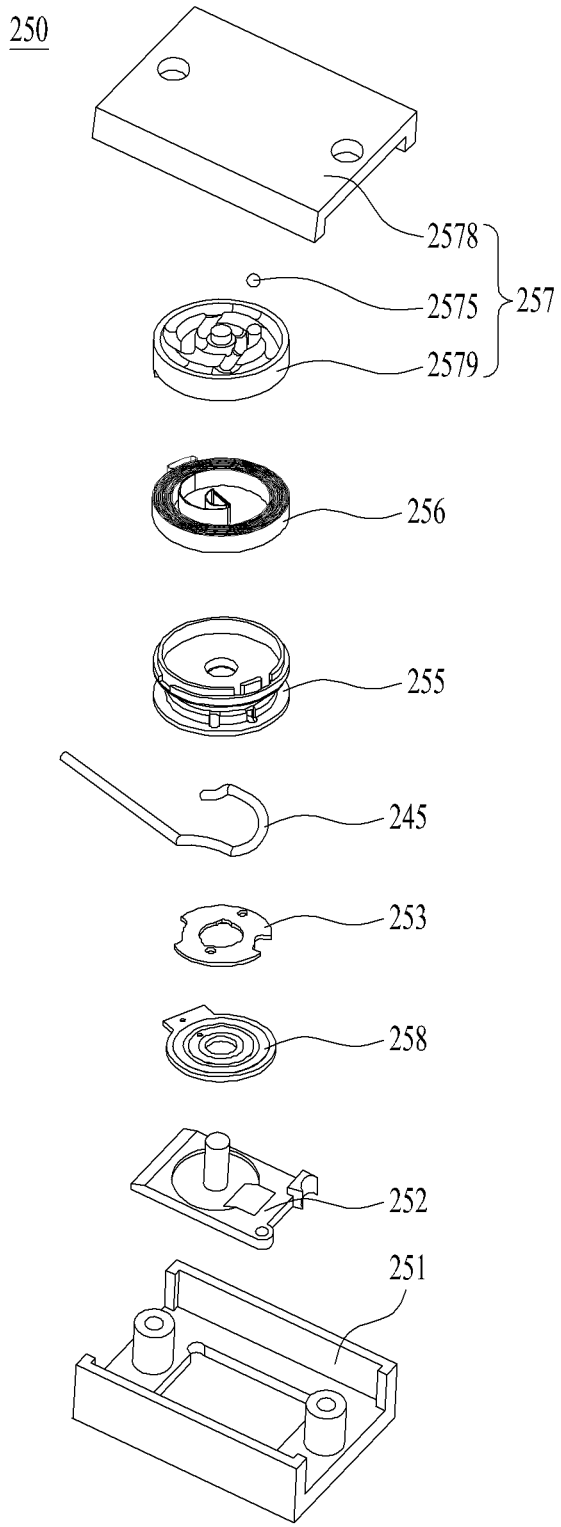
FIG. 8 is an exploded perspective diagram illustrating an auto-winding device provided in one example of the portable sound equipment in accordance with the present disclosure.

FIG. 8 is an exploded perspective diagram illustrating the auto-winding device 250 provided in one example of the portable sound equipment 200 in accordance with the present disclosure. the auto-winding device 250 includes a shaft 252 fixed to the housing 220; a wheel 255 rotary on the shaft 252 to have the sound cable 245 wound there around; an elastic material wound in a spiral shape and having one end secured to the shaft 252 and the other end secured to an internal portion of the wheel 255; and a substrate 258 connected to the controller and linked to one end of the wheel 255.

The shaft 252 is fixed to the housing 220. In this instance, the shaft 252 may be directly fixed. In case the auto-winding device 250 is modulated in the case 251 of the auto-winding device 250 as shown in FIG. 7, the shaft 252 is secured to the case 251 and the case 251 of the auto-winding device 250 is fixed to the housing 200 and the shaft 252 is then fixed to the housing 220.

The wheel 255 rotatable with respect to the shaft 252 may include a predetermined space where the plate spring 256 is arranged and a lateral wall the sound cable 245 is wound around. One end of the sound cable is connected to the board 258 via a brush 253, so that the brush 253 keeps the connected state with an electrode of the board 258 to transmit a signal, even when the wheel is rotating. The board 258 is connected to the printed circuit board 281, to transfer the audio signal to the earbuds 240.

The plate spring 256 arranged in the wheel 255 may be a spiral spring 256 having a band-shaped metallic plate wound there around in a vortex shape as shown in FIG. 7. The center of the spiral spring 256 is fixed to the shaft 252 and an outer end of the spiral spring 256 is coupled to the wheel 255. In this instance, when the user pulls the sound cable 245 and then rotates the wheel 255 in the reverse of the vortex-shaped winding direction of the spiral spring 256, the number of the spiral spring 256 windings is decreased. When the user removes the force used in pulling the sound cable 245, the wheel 255 is rotated in the reverse direction by the restitution force of the spiral spring 256 and then the sound cable 245 is wound around the outer wall of the wheel 255. While the sound cable 245 is wound around the outer wall of the wheel 255 rotated in the reverse direction by the restitution force of the spiral spring, the earbuds 240 are held in the earbud holders 225, respectively.

The earbuds 240 have to keep a drawn-out state to allow the user to listen to the music even when the user removes the force. Accordingly, a stopper module 257 may be further provided to stop the rotation of the wheel 255 performed by the spiral spring 256.

Figure 9:
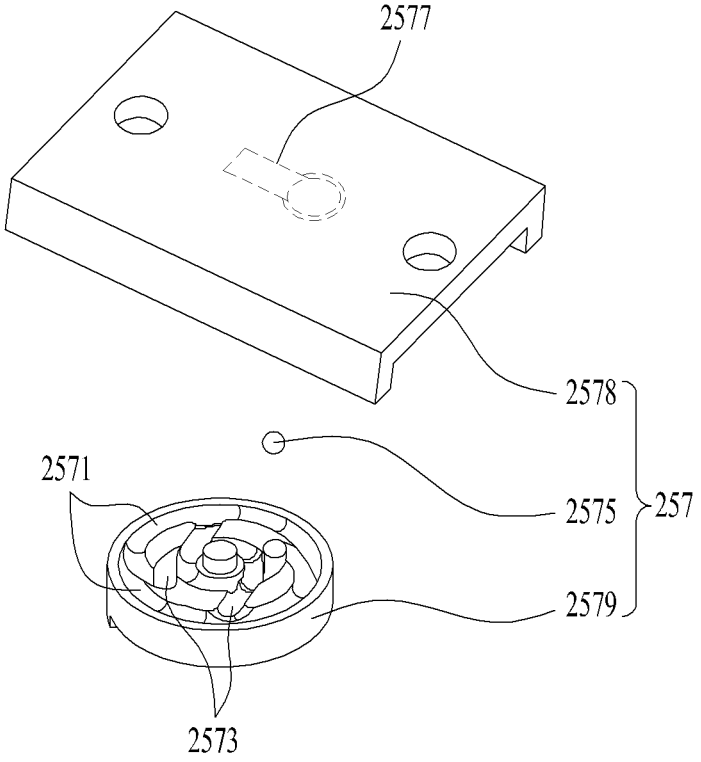
FIG. 9 is a perspective diagram illustrating a stopper module provided in one example of the portable sound equipment in accordance with the present disclosure.

FIG. 9 is a perspective diagram illustrating the stopper module 257 provided in one example of the portable sound equipment in accordance with the present disclosure. A predetermined portion of the stopper module 257 is fixed to the housing 220 and the other portion of the stopper module 257 rotates together with the wheel 255. The portion (i.e., a first stopper module 2578) fixed to the housing 220 may be the case 251 of the auto-winding device 250 and a linear slot 2577 may be formed in the portion.

The other portion (i.e., a second stopper module 2579) fixed to the wheel 255 to rotate together with the wheel 255 and a moving rail formed in plural-arcs-shape is formed in the surface of the second stopper module 2579 which faces the first stopper module 2578.

(a) of FIG. 9 is a diagram illustrating the surface of the first stopper module 2578 which faces the second stopper module and (b) of FIG. 9 is a diagram illustrating the surface of the second stopper module 2579 which faces the first stopper module 2578.

A ball 2575 may be disposed between the linear slot 2577 and the moving rail 2571 and the ball 2575 may move on the moving rail 2571 according to the rotation of the wheel 255. Substantially, the second stopper module 2579 is rotated and the moving rail 2571 is rotated, so that the ball 2575 may be moving on the linear slot 2577 in a linear direction, not be rotated.

A stopping groove 2573 may be formed in the moving rail 2571 and the stopping groove 2573 is recessed, compared with the moving rail 2571. When reaching the stopping groove 2573, the ball 2575 falls in the stopping groove 2573 and it is hooked to the first stopper module 2578 to stop the rotation of the second stopper module 2579 and the rotation of the wheel 255.

When the user re-pulls the sound cable 245 lightly, the ball 2575 gets out of the stopping groove 2573. When the user releases the sound cable 245, the wheel 255 is rotated in the reverse direction by the restitution force of the spiral spring 256 and the ball 2575 is arranged on the moving rail 2571 not to interfere in the rotation of the wheel 255. Such the method of pulling and releasing the sound cable 245, using the stopper module 257 facilitate the sound cable 245 kept in the housing 220 or drawn from the housing 220.

Figure 10:
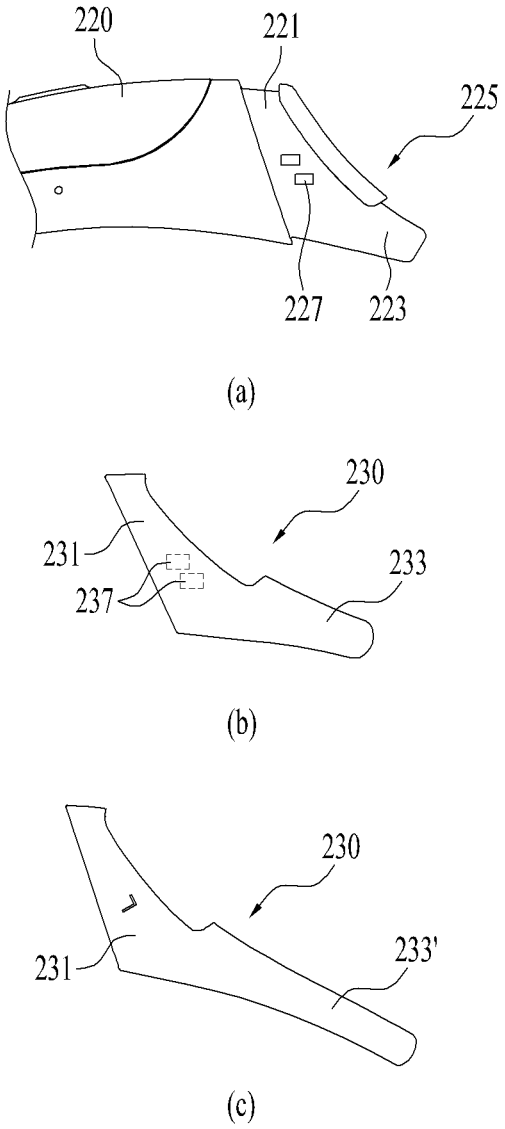
FIG. 10 is a diagram illustrating a wingtip coupling groove and a wingtip provided in one example of the portable sound equipment in accordance with the present disclosure.

FIG. 10 is a diagram illustrating a wingtip coupling groove and a wingtip 230 provided in one example of the portable sound equipment 200 in accordance with the present disclosure. As it is designed to fit the user's neck, the portable sound equipment 200 in accordance with the present disclosure is substantially short to a user with a thick neck and long for a user with a thin neck. In other words, each of the users has his or her neck size and an accessory for adjusting the portable sound equipment 200 to fit the user's neck size is necessary.

The wingtip 230 configured to extend the C-shaped curvature may be coupled to the end of the housing 220. The end of the housing 220 includes a wingtip coupling groove to which the wingtip 230 is coupled. The wingtip coupling groove 221 is the groove adjacent to the end of the housing and formed in a ring shape along the circumference of the housing 220. The length of the wingtip coupling groove 221 is corresponding to the thickness of the wingtip 230. The wingtip coupling groove shown in FIG. 10(*a*) has different widths. The outer portion of the wingtip coupling groove when the user wears the portable sound equipment 200 is narrow and the width is getting increased toward the inner portion of the wingtip coupling groove.

The wingtip 230 includes a rubber ring 231 inserted in the wingtip coupling groove 221. The wingtip 230 is formed of an elastic material. Polyurethane may be used for the wingtip 230, like the band cover 216 of the flexible band 210. When poly urethane formed thin, polyurethane is deformed easily. When polyurethane is formed thick, elastic strain of polyurethane is reduced. The portion where the rubber ring 231 is provided is formed in thin tape shape and the thickness of the rubber ring 231 is corresponding to the depth of the wingtip coupling groove 221. Since the widths of the wingtip coupling groove 221 are not uniform, the rubber ring 231 inserted in the wingtip coupling groove 221 may not be fixed, not rotated along the circumference of the housing 220.

The wingtip 230 may further include a rubber cap 233 projected from the rubber ring 231 to extend the length of the housing 220. As shown in (b) and (c) of FIG. 10, the length of the portable sound equipment 200 may be adjusted for the user, using the wingtip 230 having the different lengths of the rubber cap 233.

The width of the wingtip coupling groove 221 is changed and the wingtip 230 is not rotated in the wingtip coupling groove 221. To fix the wingtip 230 to the housing more stably, a wingtip fixing projection 223 may be further provided to couple the rubber cap thereto. The rubber cap 233 has a bag shape with an open side and covers the wingtip fixing projection, coupled to the wingtip projection.

The wingtip fixing projection 223 is coupled to the rubber cap, so that it can prevent the wingtip 230 from rotating in the wingtip coupling groove 221 and reinforce the strength of the rubber cap 233 to help the portable sound equipment 200 fit the user's neck stably.

The wingtip projection 223 is extended from the wingtip coupling groove 221 to be projected sharply. The rubber cap 233 is provided in an internal side of the portable sound equipment 200 in a direction toward the user's neck in contact. The wingtip fixing projection is also projected from the inner C-shaped curved surface of the portable sound equipment 200. The wingtip projection fixing projection 223 has a cross sectional area getting decreasing toward an end in a cone shape and the rubber cap 233 has also a cone shape with a pointed top, corresponding to the wingtip projection fixing projection.

Electronic devices such as an auxiliary battery and the speaker 243 may be provided in the wingtip 230. The electronic devices are the accessory devices for expanding the functions of the portable sound equipment 200 so that the user may add necessary functions. As shown in FIG. 10(*a*), a first terminal 227 may be formed in the wingtip coupling groove 221 or in the wingtip fixing projection 223, to be electrically connected to the printed circuit board 281 mounted in the housing 220. Corresponding to the first terminal, a second terminal 237 electrically connected to the electronic components mounted in the wingtip 230 is exposed to an inner surface of the rubber ring 231 or the rubber cap 233 provided in the wingtip 230. When the first terminal 227 contacts with the second terminal 237, the electronic components mounted in the wingtip 230 may be useable.

Figure 11:
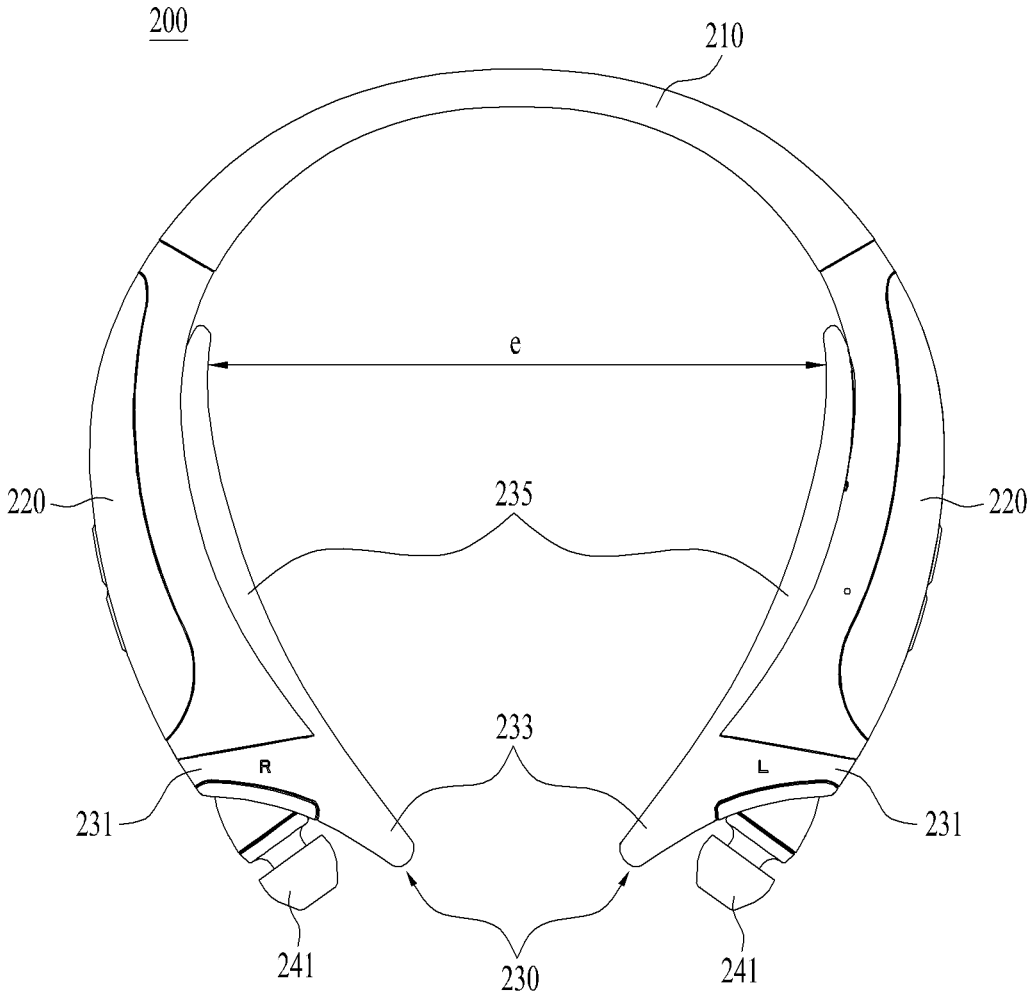
FIG. 11 is a diagram illustrating another example of the portable sound equipment in accordance with the present disclosure.

FIG. 11 is a diagram illustrating another example of the portable sound equipment 200 in accordance with the present disclosure. The portable sound equipment might have a disadvantage of falling down to the collarbone, failing to fit the user's neck, in case the user's neck size is larger or smaller than a basic neck size. If positioned in the collarbone, the portable sound equipment 200 happens to bump into the collarbone to make the user feel uncomfortable to use. Accordingly, it is required to secure the portable sound equipment 200 to the user's neck not to allow it shaking.

For the user with the thin neck, the wingtip 230 may be used as shown in FIG. 11. The rubber cap 233 is shorter and a compensating rib 235 put on an inner circumference of the housing 220 is further provided in the wingtip 230. The compensating rib 235 is extended in an internal direction of the C-shaped curvature of the housing which is the reverse direction of the rubber cap 233 extension. Accordingly, the diameter of the portable sound equipment 200 may be reduced (e<b) and the portable sound equipment 200 may perfectly fit the user's thin neck.

In addition, a length adjusting unit may be further provided in the housing or flexible band or between the housing and the flexible band. A signal wire or a flexible printed circuit board arranged in the length adjusting unit may be twisted or folded in spiral shape. When the length adjusting unit is lengthened, the twisted or folded portion is unfolded or spread.

The length adjusting unit may be shortened when the first housing is insertedly fitted into the second housing or folded like a fan, using a foldable material. The length adjusting unit may be lengthened when spread.

Figure 12:
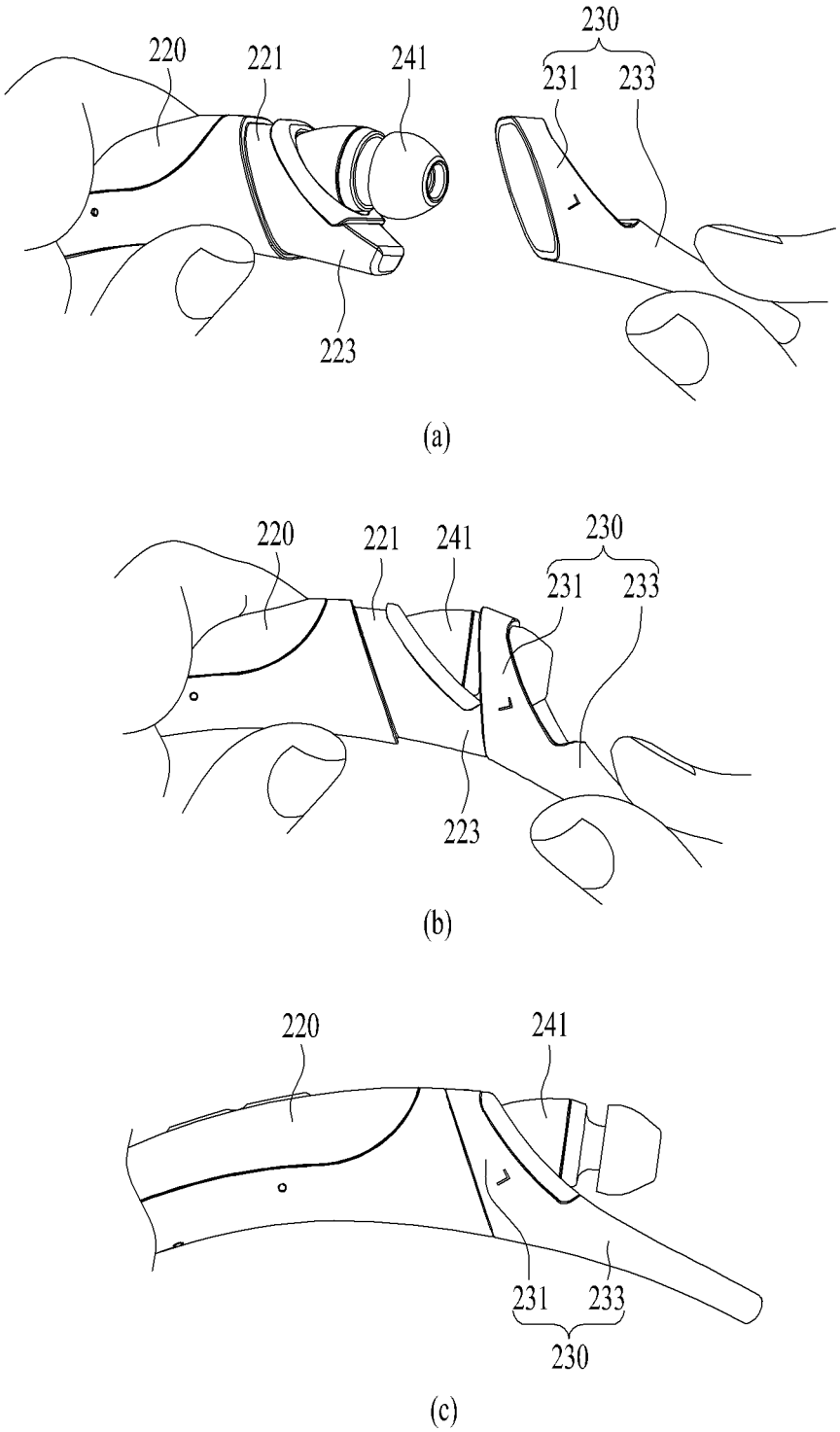
FIG. 12 is a diagram illustrating a process of inserting the wingtip in the wingtip coupling groove provided in one example of the portable sound equipment in accordance with the present disclosure.

FIG. 12 is a diagram illustrating the process of inserting the wingtip 230 in the wingtip coupling groove provided in one example of the portable sound equipment 200 in accordance with the present disclosure. The earbud holder 225 in accordance with the present disclosure is arranged in the end of the housing 220 and exposed to the end of the housing, penetrating the rubber ring 231.

When the earbud holder 225 is provided in the end of the housing 220, the earbud 240 is not projected from a lateral surface of the housing 220. Also, the flexible band 210, the housing 220 and the earbuds 240 are arranged along the C-shaped curvature in parallel, so that a clean exterior appearance may be provided to the portable sound equipment 200.

In a state of holding the housing 220 and the wingtip 230 to locate the wingtip fixing projection 223 and the rubber cap in the same direction, the user may insert the wingtip 230 in the end of the housing 220 to allow the earbud 240 held in the earbud holder 225 to penetrate the rubber ring 231. The rubber ring 231 is formed of an elastic material and the size of the rubber ring 231 is changeable, so that the earbud can penetrate the rubber ring easily. The wingtip fixing projection 223 is extended from the end of the housing 220 in the same direction as the housing 220 is extended. Accordingly, when the wingtip 230 is inserted in the wingtip fixing projection arranged in a direction parallel to the inserting direction of the wingtip 230, the wingtip fixing projection 223 may be inserted in the rubber cap 233 smoothly.

Once the rubber ring 231 and the rubber cap 233 are inserted in the wingtip coupling groove 221 and the wingtip fixing projection 223, the end of the housing 220 is extended as shown in FIG. 12(*c*).

Figure 13:
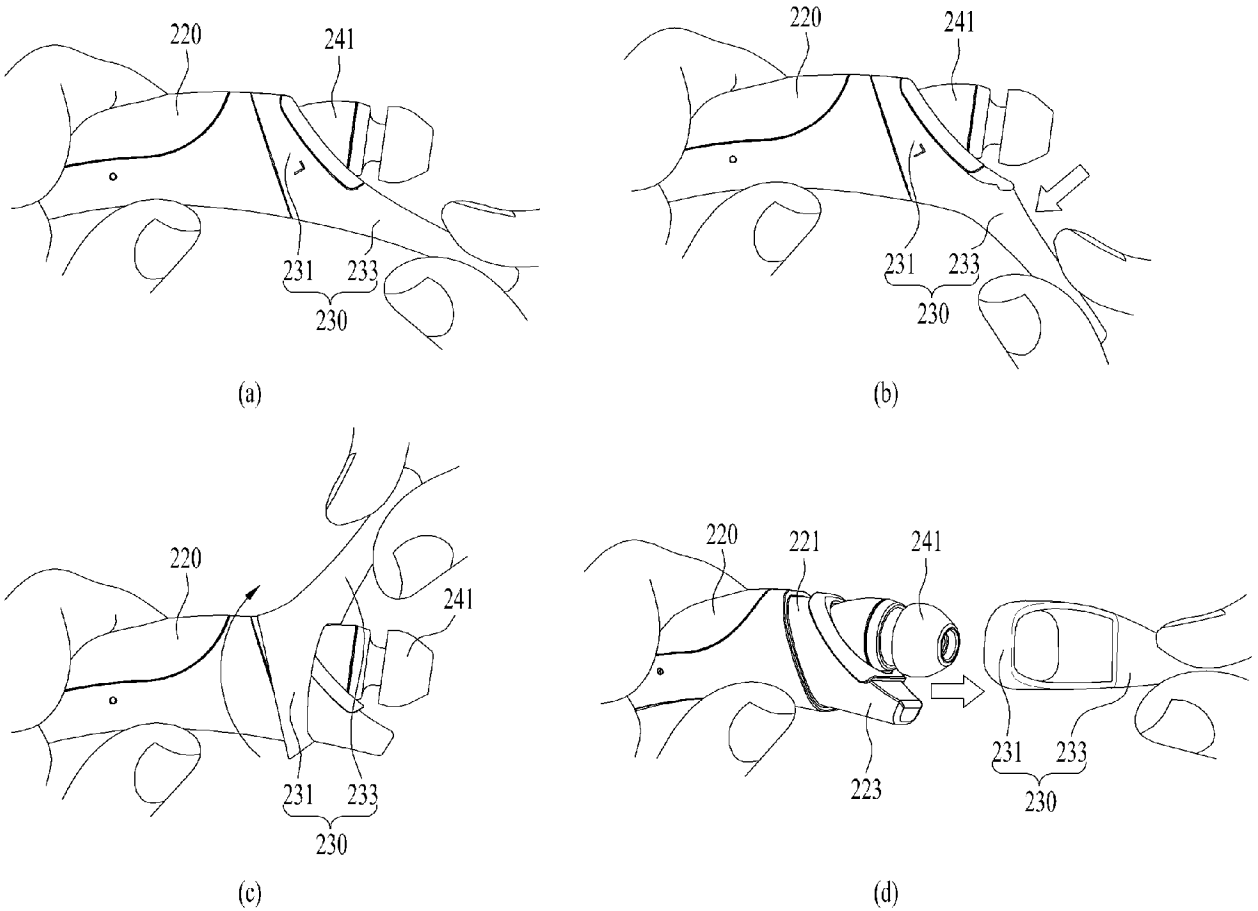
FIG. 13 is a diagram illustrating a process of decoupling the wingtip from the wingtip coupling groove provided in one example of the portable sound equipment in accordance with the present disclosure.

FIG. 13 is a diagram illustrating a process of decoupling the wingtip 230 from the wingtip coupling groove provided in one example of the portable sound equipment 200 in accordance with the present disclosure. Even if the user pulls the wingtip 230 in the inserting direction, the rubber ring 231 is coupled to the wingtip coupling groove 221 and the wingtip 230 is not decoupled accordingly. When the user rotates the wingtip 230 along the circumferential direction of the housing 220 to decouple the rubber ring 231 from the wingtip coupling groove 221, the width of the wingtip coupling groove 221 is changed and the rubber ring 231 is decoupled from the wingtip coupling groove 221 in the portion wider than the width of the wingtip coupling groove 221.

As the wingtip fixing projection 223 is inserted in the rubber cap 233, the rubber ring 231 is not rotated. Accordingly, holding the rubber cap 233 as shown in FIG. 13(*a*), the user decouple the wingtip fixing projection 223 from the rubber cap 233 as shown in (b) and rotates the wingtip 230 to locate the rubber cap 233 and the wingtip fixing projection 223 in the reverse positions as shown in (c). In a state where the rubber ring 231 is decoupled from the wingtip coupling groove 221, the user pulls the wingtip 230 in the reverse of the wingtip inserting direction and then the wingtip 230 is decoupled from the housing completely.

As mentioned above, the portable sound equipment in accordance with the present disclosure may realize bending levels of the band gradually. Accordingly, the user can feel comfortable when wearing the portable sound equipment 200 and the disadvantage of the portable sound equipment easily moving or falling from the user's neck may be solved, when the portable sound equipment is worn on the user's neck.

In addition, the portable sound equipment in accordance with the present disclosure includes the structure configured to couple the earbuds 240 in the earbud holders 225 easily and it has a convenient advantage of easy earbud portability.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A portable sound equipment comprising:

a flexible band;

a pair of housings coupled to both ends of the band, respectively;

an earbud holder provided in each of the housings;

an earbud detachably held in the earbud holder and outputting sound;

a controller provided in each housing and connected to the respective earbud to control the respective earbud;

a sound cable provided in each housing and configured to connect the respective earbud and the respective controller with each other; and a wingtip detachably coupled to an end of each housing and comprising an elastic material, wherein each wingtip includes a rubber ring to expose the earbud holders, and wherein the earbuds and the sound cables penetrate an opening of the rubber ring.

2. The portable sound equipment of claim 1, further comprising:

a wingtip coupling groove recessed along a circumference of each housing; and a wingtip fixing projection projected from each wingtip coupling groove along a longitudinal direction of the respective housing, wherein each wingtip comprises:

the rubber ring coupled to the wingtip coupling groove; and a rubber cap projected from the rubber ring to cover the wingtip fixing projection.

3. The portable sound equipment of claim 2, wherein a width of each wingtip coupling groove is variable along a circumferential direction of the respective housing.

4. The portable sound equipment of claim 2, further comprising a first terminal formed in each wingtip coupling groove and connected to the respective controller; and a second terminal formed in the respective rubber ring, corresponding to the first terminal, and connected to an electronic component mounted in the respective wingtip.

5. The portable sound equipment of claim 2, wherein the flexible band and the pair of housings form a C-shaped curvature and comprise a contact surface in contact with the user's neck when a user wears the portable sound equipment around the neck.

6. The portable sound equipment of claim 5, wherein each wingtip further comprises a compensating rib extending from the respective rubber ring and configured to cover the contact surface of the respective housing.

7. The portable sound equipment of claim 5, wherein each rubber cap is extended longer than the respective wingtip fixing projection and lengthens the C-shaped curvature.

8. The portable sound equipment of claim 5, wherein each wingtip fixing projection has a contact surface continued from the contact surface of the C-shaped curvature.

9. The portable sound equipment of claim 1, further comprising:

a switch provided in one of the pair of housings or in the flexible band, wherein the flexible band and the pair of housings form a C-shaped curvature and comprise a contact surface in contact with a user's neck when the user wears the portable sound equipment around the neck, and the switch generates an ON signal when the portable sound equipment is worn on the neck of the user.

10. The portable sound equipment of claim 9, wherein:

the switch comprises a sensor provided in the flexible band and configured to sense curvature variation of the flexible band, and when the curvature of the flexible band is kept as a second curvature smaller than a first curvature after varied into a first curvature, the switch generates the ON signal.

11. The portable sound equipment of claim 9, further comprising:

a wireless communication unit configured to transmit and receive a signal to and from an external terminal, wherein the controllers switch on the power when sensing the ON signal and synchronize the portable sound equipment with the external terminal.

12. The portable sound equipment of claim 1, wherein the flexible band comprises, a shape memory alloy wire provided therein;

a signal wire configured to transmit and receive a signal traveling between the pair of the housings;

a coupling bracket provided in each end of the flexible band to couple with the housings; and a band cover configured to cover the shape memory alloy wire and the signal wire and integrally formed with the shape memory alloy wire, the signal wire and the coupling bracket in a manner of insert injection molding.

13. The portable sound equipment of claim 12, further comprising:

a polymer pipe configured to cover the signal wire and the shape memory alloy wire.

14. The portable sound equipment of claim 1, wherein the flexible band and the housings comprise a polyurethane material or polyurethane is coated on the flexible band and the housings.

15. The portable sound equipment of claim 1, wherein the flexible band or one of the pair of housings comprise a length adjusting unit having a variable length and configured to keep the varied length.

16. The portable sound equipment of claim 1, further comprising:

a speaker mounted in each housing and configured to output a signal according to an audio signal; and a sound hole formed in each housing, located adjacent to the flexible band and configured to output the sound generated in the respective speaker.

17. The portable sound equipment of claim 1, further comprising:

an auto-winding device mounted in each housing and the respective sound cable is wound around the respective auto-winding device, wherein each auto-winding device comprises:

a shaft fixed to the respective housing;

a wheel rotatable about the shaft and having the sound cable wound there around;

a plate spring comprising one end coupled to the shaft and the other end coupled to an internal portion of the wheel; and a board connected to the respective controller and linked to one end of the wheel, wherein when a user applies a pulling force to the sound cable, the sound cable is released from the wheel and the wheel is rotated in a first direction, and when the user removes the pulling force, the wheel is rotated in a second direction by a restitution force of the plate spring and the cable is wound around the wheel.

18. The portable sound equipment of claim 17, wherein each auto-winding device further comprises:

a plurality of moving rails formed in a surface of the wheel in plural-arcs shape;

a stopping groove provided between the moving rails;

a linear slot formed in a predetermined position which faces the rails; and a ball fitted between the slot and the moving rails and configured to move along the slot according to the rotation of the wheel and to restrict the rotation of the wheel when held in the stopping groove.

19. A portable sound equipment comprising:

a flexible band;

a pair of housings coupled to both ends of the band, respectively;

an earbud holder provided in each of the housings;

an earbud detachably held in the earbud holder and outputting sound;

a controller provided in each housing and connected to the respective earbud to control the earbud;

a sound cable configured to connect the respective earbud and the respective controller with each other;

a sensor provided in the flexible band and configured to sense curvature variation of the flexible band, and wherein the controller generates the ON signal when the curvature of the flexible band is kept as a second curvature smaller than a first curvature after varied into a first curvature, and wherein the flexible band and the housing comprise a contact surface in contact with the user's neck when a user wears the portable sound equipment around the neck.

20. A portable sound equipment comprising:

a flexible band;

a pair of housings coupled to both ends of the band, respectively;

an earbud holder provided in each of the housings;

an earbud detachably held in the earbud holder and outputting sound;

a controller provided in each housing and connected to the respective earbud to control the earbud;

a sound cable configured to connect the respective earbud and the respective controller with each other; and wherein the flexible band comprises:

a shape memory alloy wire provided therein;

a signal wire configured to transmit and receive a signal traveling between the pair of the housings;

a polymer pipe configured to cover the signal wire and the shape memory alloy wire;

a coupling bracket provided in each end of the flexible band to couple with the housings; and a band cover configured to cover the shape memory alloy wire, the signal wire and the polymer pipe integrally formed with the shape memory alloy wire, the signal wire, the polymer pipe and the coupling bracket in a manner of insert injection molding.

* * * * *